US005374293A

United States Patent [19]

Takashita et al.

[11] Patent Number: 5,374,293

[45] Date of Patent: Dec. 20, 1994

[54] POLISHING/GRINDING TOOL AND PROCESS FOR PRODUCING THE SAME

[75] Inventors: Junji Takashita, Yokohama; Hironori Yamamoto, Chigasaki; Nobuo Nakamura, Yokohama; Toru Imanari, Kawasaki; Takashi Kozakai, Setagaya, all of Japan

[73] Assignee: Canon Kabushiki Kaisha, Tokyo, Japan

[21] Appl. No.: 67,099

[22] Filed: May 26, 1993

[30] Foreign Application Priority Data

May 29, 1992 [JP] Japan ..... 4-139214
Apr. 22, 1993 [JP] Japan ..... 5-96040

[51] Int. Cl.[5] ..... B24D 3/24; B24D 11/00

[52] U.S. Cl. ..... 51/295; 51/293; 51/297

[58] Field of Search ..... 51/293, 295, 297

[56] References Cited

U.S. PATENT DOCUMENTS 4,908,046 3/1990 Wiand ..... 51/295
4,945,686 8/1990 Wiand ..... 51/295
4,974,368 12/1990 Miyamoto et al. ..... 51/55
4,984,940 1/1991 Bryant et al. ..... 51/295
5,022,895 6/1991 Wiand ..... 51/295
5,097,637 3/1992 Shepherd ..... 51/295
5,133,782 7/1992 Wiand ..... 51/295

*Primary Examiner*—Mark L. Bell
*Assistant Examiner*—Deborah Jones
*Attorney, Agent, or Firm*—Fitzpatrick, Cella, Harper & Scinto

[57] ABSTRACT

Disclosed is a precise grinding grindstone in which the-heights of the grinding particles can be aligned even if large particles are employed. An underlying plated layer is formed on a substrate, and grinding particles are dispersed as a single layer thereon. The grinding particles are pressed toward the plated layer by a mold member and are partly pressed into the plated layer, whereby the heights of the grinding particles are aligned. Then, the particles are supported by a binding plated layer. The protrusion of the particles can be arbitrarily selected by regulating the thickness of the binding plated layer.

15 Claims, 8 Drawing Sheets

POLISHING/GRINDING TOOL AND PROCESS FOR PRODUCING THE SAME

BACKGROUND OF THE INVENTION

1. Field of the Invention

The present invention relates to a precise grinding grindstone for grinding the surface of a hard brittle material such as glass or a semiconductive material with a satisfactory surface roughness, and a process for producing the same.

2. Related Background Art

Among such precise grinding grindstones, there are already known a grindstone in which plural layers of grinding particles are dispersed in a binder and fixed onto a substrate, and another grindstone in which a layer of grinding particles are fixed on a substrate by an electroplating process.

However, in such conventionally known grindstones, the one having plural layers of grinding particles dispersed in and fixed by the binder on the substrate shows unaligned end positions of the grinding particles because they are randomly supported in the binder. Also, the grindstone prepared by the electro-plating method has a layer of grinding particles fixed on the substrate, but the heights of the grinding particles are uneven, because of the unevenness in the size or shape of the grinding particles themselves. When the end positions of the grinding particles are unaligned, a high load is applied in the grinding operation to several grinding particles most protruding from the grindstone, thus providing a large cutting depth by such protruding several grinding particles.

In the grinding operation of a hard brittle article, the grinding is conducted in the shear mode if the cutting depth is less than a predetermined depth, and in the brittle mode if the cutting depth exceeds the predetermined depth. The predetermined cutting depth is called a critical cutting depth $d_c$, which is an inherent value of the material. In the brittle-mode grinding, the article is ground with brittle breaking, and the ground surface becomes rougher than the desired surface roughness. Thus, when the cutting depth becomes larger and exceeds the critical depth $d_c$, the work article is not ground with the shear mode indicating no brittle breaking but with the brittle mode, so that the desired surface roughness is hardly obtained.

The unevenness in the end heights of the grinding particles may be reduced by decreasing the size of the grinding particles, but, in such case, the amount of protrusion of the grinding particles becomes smaller, so that the gaps between the grinding particles will be easily clogged. Also, a smaller size of the grinding particles leads to a drawback that the particles tend to drop off due to a weakened holding force for the particles.

SUMMARY OF THE INVENTION

The object of the present invention is to provide a precise grinding grindstone in which the end heights of the grinding particles are aligned even when the particles of a large size are employed, and a process for producing such grindstone.

The above-mentioned object can be attained according to the present invention of a precise grinding grindstone comprising, a substrate; a layer of a supporting material formed on the surface of the substrate; a plurality of grinding particles formed as a dispersed layer on the layer of the supporting material and pressed toward the supporting material layer by a smoothly-finished mold member of which surface coincides with the grinding surface of the fine grindstone to be produced, whereby the grinding particles are partly pressed into the support material layer; and a layer of a binder provided on the supporting material layer in such a manner that the outer ends of the grinding particles protrude therefrom; wherein the supporting material layer may be softer than the grinding particles or the binder layer.

Also, there is provided a precise grinding grindstone comprising, a substrate; and a binder layer fixed on the surface of the substrate and supporting a plurality of grinding particles in such a dispersed state that the outer ends of the particles are exposed externally; wherein the binder layer is formed by means of a mold member of which surface coincides with the shape of the grinding surface of the fine grindstone to be produced and is finished smoothly in such a manner as to cover a plurality of grinding particles placed in a dispersed manner on the surface of the mold member and is subsequently peeled off from the mold member; and the outer ends of the grinding particles supported by the binder layer are exposed therefrom by eliminating the surface of the peeled binder layer.

In such case the grinding particles may be placed in dispersed manner on the surface of the mold member by growing artificial diamonds on the mold member by vapor phase deposition, and the removing of the binder layer may be conducted by an acid treatment.

Also the process of the present invention for producing a precise grinding grindstone comprises the steps of: forming a layer of a supporting material on the surface of a substrate; placing a dispersed layer of a plurality of grinding particles on the surface of the supporting material layer; pressing the grinding particles toward the supporting material layer, by a smoothly finished mold member of which the surface coincides with the shape of the grinding surface of the fine grindstone to be produced, thereby pressing the grinding particles partly into the supporting material layer; and forming a layer of a binder on the surface of the supporting material layer in such a manner that the outer ends of the grinding particles protrude externally; wherein the supporting material layer may be softer than the grinding particles and/or the binder layer.

There is also provided a process comprising the steps of: placing a plurality of grinding particles in a dispersed manner on a smoothly finished mold member of which the surface coincides with the shape of the grinding surface of the fine grindstone to be produced; forming a layer of a supporting material on the surface of the mold member in such a manner as to cover the grinding particles; fixing a substrate on the surface of the supporting material layer; peeling the supporting material layer from the mold member; and removing the surface of the peeled supporting material layer thereby exposing the ends of the grinding particles.

In such case the grinding particles may be placed in a dispersed manner on the surface of the mold member by growing artificial diamonds on the surface of the mold member by vapor phase deposition, and the removing of the surface of the binder layer may be conducted by an acid treatment.

According to the invention, the plural grinding particles placed in a dispersed manner on the surface of the supporting material layer are pressed toward the layer by a mold member and are partly pressed into the supporting material layer. Since the surface of the pressing mold member coincides with the shape of the grinding surface of the precise grinding grindstone to be produced, the heights of the ends of the grinding particles are aligned by the contact of the ends with the pressing mold member. The grinding particles with the aligned heights of the ends thereof, are firmly supported by the binder layer with the ends exposed from the layer, and the amount of protrusion of the grinding particles can be arbitrarily selected by regulating the thickness of the binder layer.

According to another invention, the binder layer is formed so as to cover a plurality of grinding particles placed in a dispersed manner on a smoothly finished mold member of which the surface coincides with the shape of the grinding surface of the fine grindstone to be produced, then is fixed to a substrate and is then peeled off from the mold member. Consequently, the grinding particles are embedded and supported in a state aligned at the ends thereof on the surface of the mold member which has been in contact with the mold member. Then, by removing the surfacial part of the binder layer, the grinding particles become exposed with aligned heights of the ends thereof from the surface of the binder layer, and the protrusion of the grinding particles can be arbitrarily selected by regulating the amount of removing of the binder layer.

BRIEF DESCRIPTION OF THE DRAWINGS

FIGS. 1A to 1C are views showing producing steps of a first embodiment of the precise grinding grindstone of the present invention, wherein FIG. 1A is a cross-sectional view of a state in which the grinding particles are placed in a dispersed manner on the substrate, FIG. 1B is a cross-sectional view of a state in which the grinding particles are pressed, and FIG. 1C is a cross-sectional view of a state in which the grinding particles are supported by a binding plated layer;

FIGS. 6A to 6E are views showing the producing steps of a second embodiment of the precise grinding grindstone of the present invention, wherein FIG. 6A is a cross-sectional view of a state in which the grinding particles are placed in a dispersed manner on the mold member; FIG. 6B is a cross-sectional view of a state in which a binding plated layer is formed, covering the grinding particles; FIG. 6C is a cross-sectional view of a state in which the substrate is adhered to the surface of the binding plated layer; FIG. 6D is a cross-sectional view of a state in which the mold member has been peeled off; and FIG. 6E is a cross-sectional view of a state in which the ends of the grinding particles are exposed by removing the surfacial part of the binding plated layer;

FIG. 12A is for producing the forming grindstone with a convex spherical surface, and FIG. 12B for the forming grindstone with a concave spherical surface.

DETAILED DESCRIPTION OF THE PREFERRED EMBODIMENTS

Now, the present invention will be explained in detail by preferred embodiments thereof shown in the attached drawings.

First Embodiment

At first a first embodiment of the precise grinding grindstone of the present invention will be explained with reference to FIGS. 1A to 1C, together with the producing steps therefor.

Figure 1A:
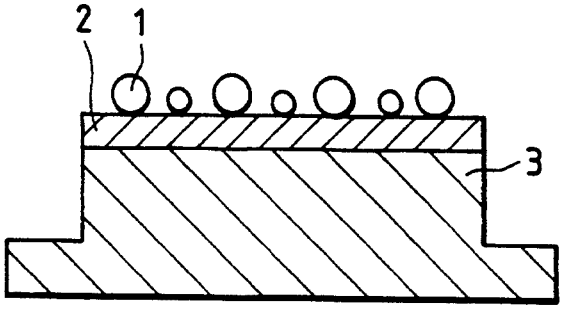
Figure 1B:
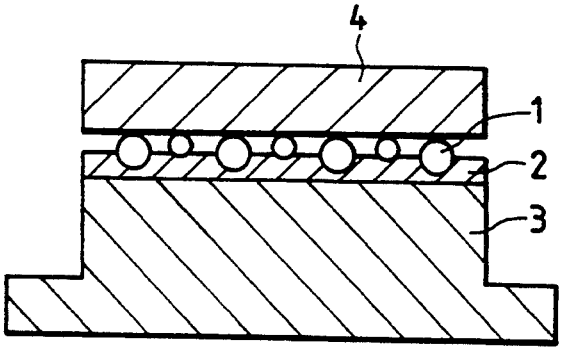
Figure 1C:
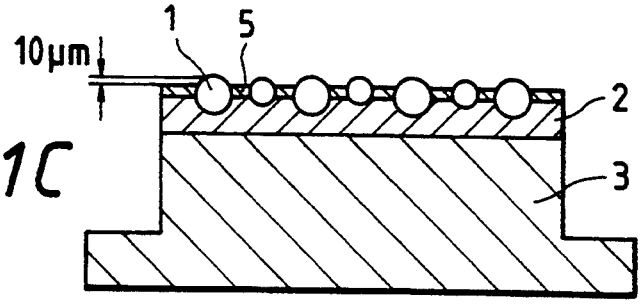
Figure 2:
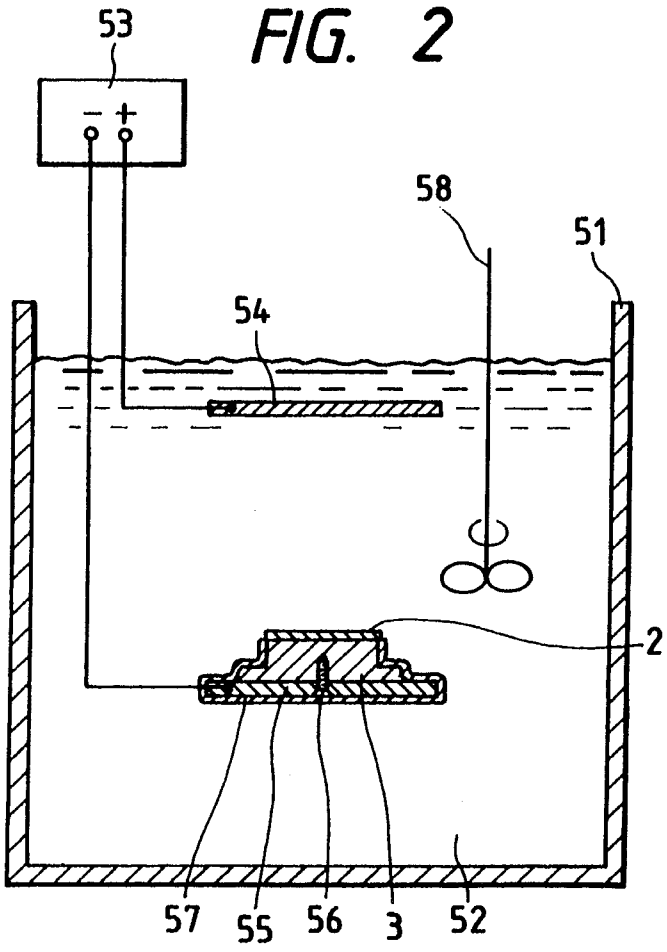
FIG. 2 is a schematic view of a plating apparatus for forming an underlying plated layer on the surface of the substrate in the precise grinding grind stone shown in FIGS. 1A to 1C.

FIGS. 1A to 1C illustrate the producing steps of the first embodiment of the precise grinding grindstone of the present invention. At first, as shown in FIG. 1A, an underlying plated layer 2 serving as a supporting material is formed on the surface of a substrate (carbon steel plate) 3 of which surface is finished in a desired shape, and a plurality of grinding particles 1 of a desired particle size is placed as a dispersed layer on the underlying plated layer 2. The underlying plated layer 2 serves to temporarily support the grinding particles, and has a hardness of about Hv 150, namely softer than the grinding particles 1. The grinding particles 1 placed in a dispersed manner on the underlying plated layer 2, are composed for example of diamond, alumina or CBN (cubic boron nitride) and are classified by screening to a certain extent according to the particle size, but the heights of the ends of the particles 1 are not aligned because of variability in the particle size. In the present embodiment there were employed diamond particles classified in size in a range of about 40 to 60 μm to have an average particle size of 50 μm. Since there is also variability in the difference between the smaller and larger diameters in the shape of each grinding particle, it is preferable to select such particles that have a smaller difference between the larger and smaller diameters. The underlying plated layer 2 is formed on the surface of the substrate 3, for example by a plating apparatus as shown in FIG. 2. FIG. 2 is a schematic view of a plating apparatus adapted for use in the formation of the underlying plated layer 2 on the substrate 3. In a plating tank 51 filled with plating liquid 52, there are provided in mutually opposed relationship, an anode 54 and a cathode 55 which are respectively connected to a DC power source 53. On a face of the cathode 55, opposed to the anode 54, the substrate 3 is fixed by a conductive screw 56 in a conductive state with the cathode 55. The underlying plated layer 2 is formed on the substrate 3 by applying a voltage between the anode 54 and the cathode 55 under agitation of the plating liquid 52 with an agitator 58. In order to prevent formation of the underlying plated layer 2 in the unnecessary area (area other than the surface of the substrate 3), there is preferably provided a mask 57 to cover the cathode 55, except for the surface of the substrate 3. The mask 57 can be composed of masking material generally utilized, such as masking liquid or a masking tape. In the present embodiment, the plating liquid 52 was standard sulfamine bath containing nickel sulfamate of 400 g/l and boric acid of 40 g/l. Plating is conducted for 20 minutes under the conditions of the plating liquid 52 maintained at 50° C., a current density of 5 A/dm$^2$ and a revolution of the agitator 58 of 60 rpm to provide the underlying plated layer 2 with a thickness of approx. 25 μm on the surface of the substrate 3.

Figure 3:
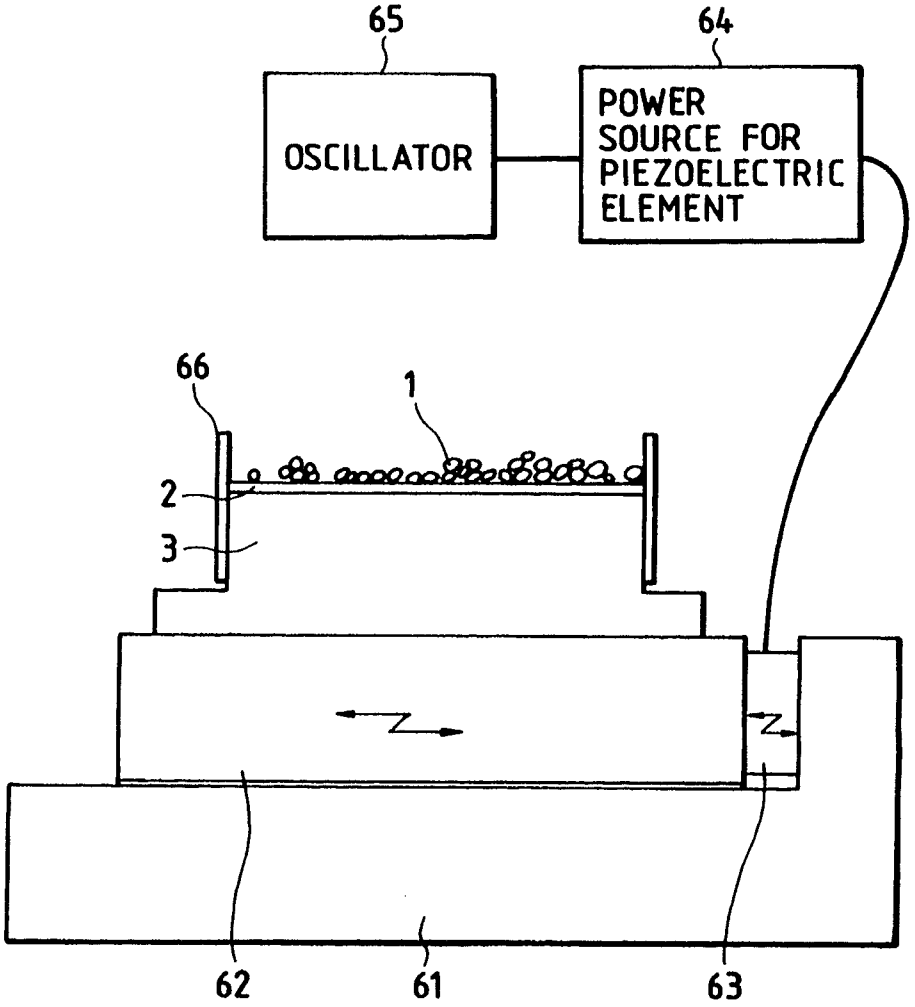
FIG. 3 is a schematic view of a dispersing apparatus for the grinding particles, for forming a layer of a plurality of grinding particles on the substrate surface bearing the underlying plated layer, in the precise grinding grindstone shown in FIGS. 1A to 1C.

The grinding particles 1 are placed in dispersed manner on the underlying plated layer 2, for example by a grinding particle dispersing apparatus as shown in FIG. 3. FIG. 3 illustrates schematically a dispersing apparatus adapted for use in dispersing a single layer of the grinding particles 1 on the surface of the substrate 3, bearing thereon the underlying plated layer 2. The dispersing apparatus is designed, as shown in FIG. 3, to vibrate a vibrating table 62 supported on a base member 61, by means of a piezoelectric element 63, in the horizontal direction (lateral direction in the drawing). The piezoelectric element 63 is so positioned as to expand and contract in the horizontal direction with a predetermined frequency by a driving voltage from a power source 64 based on a signal from an oscillator 65. In order to securely transmit the expansion and contraction movement to the vibrating table 62, the piezoelectric element 63 is firmly fixed, for example with screws, to the vibrating table 62 and the base member 61. The substrate 3 bearing the underlying plated layer 2 thereon, is fixed on the vibrating table 62 by fixed screws (not shown), and is vibrated in the horizontal direction, by the vibration of the vibrating table 62 induced by the expansion and contraction movement of the piezoelectric element 63. The grinding particles 1 charged on the underlying plated layer 2, are dispersed by the vibration so as not to mutually overlap. The charged amount of the grinding particles 1 does not exceed a predetermined amount in which the grinding particles 1 do not mutually overlap when dispersed. Also, in order to prevent the dropping of the grinding particles 1 from the underlying plated layer 2 at the vibration of the vibrating table 62, a cover 66 is provided around the substrate 3. In the present embodiment, when the grinding particles 1 were dispersed with a frequency of the vibrating table 62 of 50 Hz and an amplitude of 1 μm, the particles were dispersed as a single layer in about 5 minutes on the underlying plated layer 2.

In the following there will be explained the method for calculating the amount of the grinding particles 1 required for obtaining a single dispersed layer. The maximum number N of the non-overlapping grinding particles 1 with an average particle size d on a surface area S of the substrate 3 is given by:

$$N = \frac{2S}{\sqrt{3}\, d^2} \tag{1}$$

Also, the mass m of a grinding particle with a density $\rho$ is given by:

$$m = (\rho \times \eta \times d^3)/6 \tag{2}$$

Based on the equations (1) and (2), the mass M of the grinding particles 1 of a number N is given by:

$$M = m \times N = \frac{\rho \pi d S}{3\sqrt{3}} \tag{3}$$

The grinding particles 1 of the mass M will theoretically be dispersed without overlapping, but, in particle, the charged amount of the grinding particles 1 is selected as 90% or less of the amount calculated according to the equation (3), in consideration of the variability in the particle size.

Then, as shown in FIG. 1B, the grinding particles 1 are pressed toward the underlying plated layer 2, by means of a pressing mold member 4 of which surface coincides with the shape of the grinding surface of the grindstone to be produced. Since the underlying plated layer 2 is softer than the grinding particles 1 as mentioned above, the particles 1 pressed by the mold member are partly pressed without breaking, into the underlying plated layer 2 and temporarily supported thereby. By the pressing of the grinding particles 1 until most of the grinding particles 1 come into contact with the pressing surface of the pressing mold member 4, the particles 1 are substantially aligned at the end heights thereof. In order to avoid the deformation of the molding member 4 at the pressing of the grinding particles 1, the mold member is composed of a highly hard material such as ceramics or an ultra hard alloy with a preferable hardness of Hv 1000 or higher.

Figure 4:
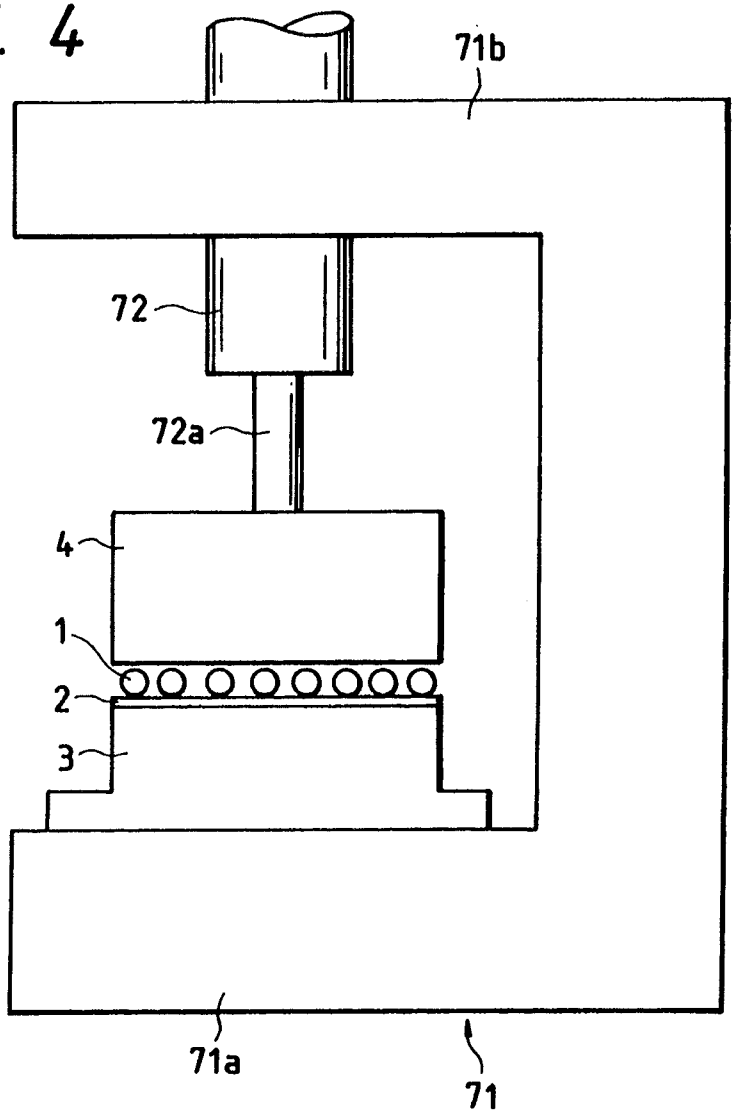
FIG. 4 is a schematic lateral view of a pressing apparatus for the grinding particles, for causing temperature supporting of the dispersed grinding particles by the underlying plated layer, in the precise grinding grindstone shown in FIGS. 1A to 1C.

In the present embodiment, the temporary supporting of the grinding particles 1 on the underlying plated layer 2 by the pressing mold member 4 was achieved by a pressing apparatus shown in FIG. 4, which is a schematic lateral view of a pressing apparatus adapted for use in causing the temporary supporting of the dispersed grinding particles on the underlying plated layer 2, in the precise grinding grindstone shown in FIGS. 1A to 1C. In the pressing apparatus, a base member 71 constitutes a principal component and is composed of a supporting part 71*a*, on which the substrate 3 is fixed by fixing screws (not shown), and an arm part 71*b* extending upwards from the supporting part 71*a* and supporting a cylinder 72 at the upper end. The cylinder 72 is operated by fluid pressure such as air or oil pressure, and has a rod 72*a* extending downwards. At the temporary supporting of the grinding particles 1, the rod 72*a* of the cylinder 72 is at first retracted, then the substrate 3 with the underlying plated layer 2 positioned upwards, supporting the dispersed grinding particles 1 thereon, is fixed with screws on the supporting part 71*a* of the base member 71, and the pressing mold member 4 is placed on the substrate 3. Subsequently, the rod 72*a* of the cylinder 72 is made to protrude, thereby applying a predetermined pressure to the mold member 4 and pressing the grinding particles 1 into the underlying plated layer 2. Thereafter, the rod 72*a* of the cylinder 72 is retracted to eliminate the pressure on the mold member 4, which is then eliminated from the substrate 3. In the present embodiment, the mold member 4 was composed of $Si_3N_4$, and the pressure on the substrate 3 was selected as 20 kg/cm$^2$.

After the grinding particles 1 are temporarily supported by the underlying plated layer 2, a binding plated layer 5 serving as a binder layer, is formed on the underlying plated layer 2, as shown in FIG. 1C, whereby the binding plated layer 5 supports the binding particles 1 in such a manner that the ends of the particles are exposed. In order to firmly support the grinding particles 1, the thickness of the binding plated layer 5 is so adjusted as to constitute at least $\frac{2}{3}$ of the average particle size of the grinding particles 1, thereby regulating the protruding amount of the grinding particles 1. The binding plated layer 5 is preferably of a high hardness in order to improve the abrasion resistance of the grindstone and extending the service life thereof.

Figure 5:
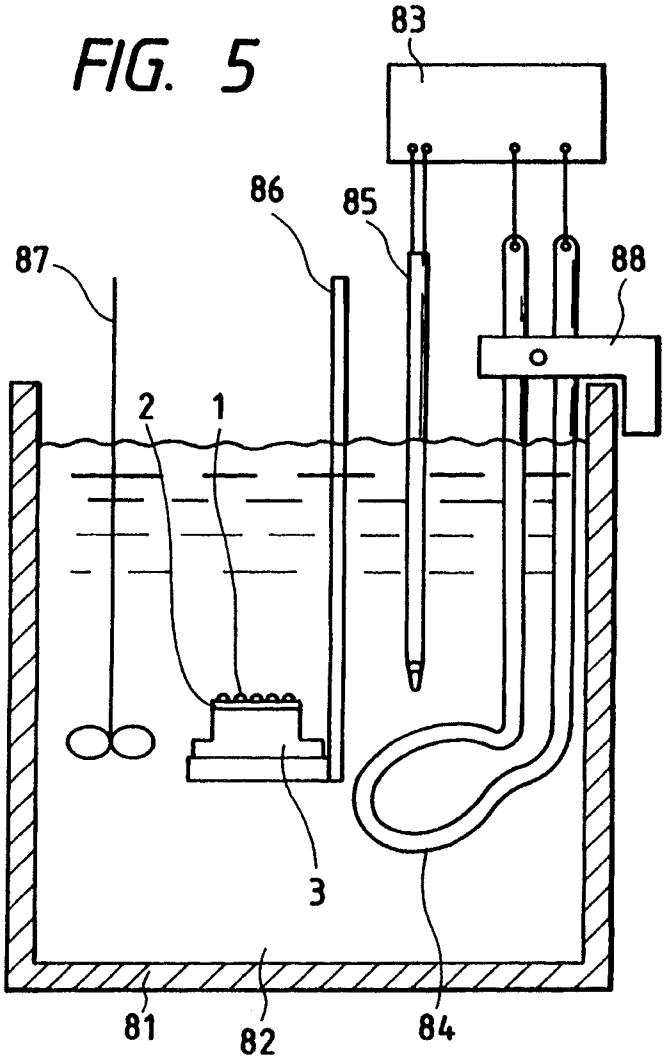
FIG. 5 is a schematic view of a plating apparatus for forming a binding plated layer, in the precise grinding grindstone shown in FIGS. 1A to 1C.

In the present embodiment, the supporting of the grinding particles 1 by the binding plated layer 5 was achieved by a plating apparatus shown in FIG. 5. FIG. 5 schematically illustrates a plating apparatus adapted for use in forming the binding plated layer in the fine grindstone shown in FIGS. 1A to 1C. The plating apparatus designed for electroless plating is provided with a plating tank 81 filled with electroless plating liquid 82. A heater 84 for maintaining the electroless plating liquid 82 at a predetermined temperature is mounted by a hook 88 on the plating tank 81, and is controlled by a temperature controller 83, based on the temperature of the liquid 82 detected by a temperature sensor 85 such as a thermocouple. The substrate 3 is fixed on a fixing member 86 with screws, and immersed in the electroless plating liquid 82 for a predetermined time under agitation of the liquid 82 with an agitator 87, whereby the binding plated layer 5 (FIG. 1C) is formed on the underlying plated layer 2. In the present embodiment, the electroless plating liquid 82 was composed of nickel-phosphor electroless plating liquid principally containing nickel sulfate and hypophosphorous acid, and the plating was conducted for 150 minutes under the conditions of a temperature of the liquid of 90° C. and a revolution of the agitator 87 of 60 rpm to form the binding plated layer 5 with a thickness of about 25 μm on the underlying plated layer 2, thereby completely supporting the grinding particles 1. Assuming that the maximum diameter of the grinding particles 1 is 60 μm and that the particles 1 with the maximum diameter are completely pressed into the underlying plated layer 2 at the temporary supporting support, the particles 1 will protrude by 35 μm from the plated layer 2. Thus, if the binding plated layer 5 is formed with a thickness of 35 μm, the grinding particles 1 will protrude by 8 to 12 μm by the variability in the thickness of the plated layer, or by 10 μm in average. In the present embodiment, the hardness of the binding plated layer 5 was made as Hv 450 or higher by a heat treatment.

As explained in the foregoing, in the present embodiment, the end heights of the grinding particles 1 can be aligned by pressing the particles 1 dispersed on the underlying plated layer 2 with the pressing mold member 4 to thereby press the particles 1 partly into the underlying plated layer 2, so that the work piece can be stably ground by the precise grinding grindstone to a desired surface roughness in the shear mode, without application of a high load to the limited grinding particles. Also, the protruding amount of the grinding particles 1, being arbitrarily adjustable by the thickness of the binding plated layer 5, can be easily selected at an optimum value within a range not causing the clogging of the gaps of the grinding particles and not inducing the dropping of the particles 1.

Second Embodiment

In the following there will be explained a second embodiment of the precise grinding grindstone of the present invention, together with the producing steps thereof with reference to FIGS. 6A to 6E.

Figure 6A:
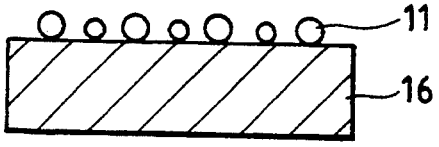

FIGS. 6A to 6E stepwise illustrate the producing steps of the precise grinding grindstone of the second embodiment. At first, as shown in FIG. 6A, grinding particles 11 of a predetermined particle size are dispersed on the surface of a mold member 16 (made of stainless steel), of which surface is finished smoothly and coincides with the shape of the grinding surface of the precise grindstone to be produced. In the present embodiment, the grinding particles 11 were composed of diamond particles classified within a particle size range of 40 to 60 μm and having an average particle size of 50 μm.

Figure 6B:
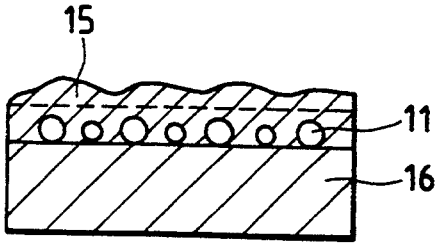

Then, as shown in FIG. 6B, a binding plated layer 15 covering the grinding particles 11, is formed on the surface of the mold member 16. The binding plated layer 15 is preferably thicker by about 0.1 mm than the largest particle size of the grinding particles 11.

Figure 6C:
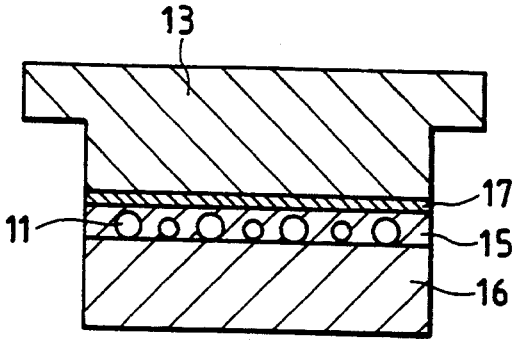
Figure 6D:
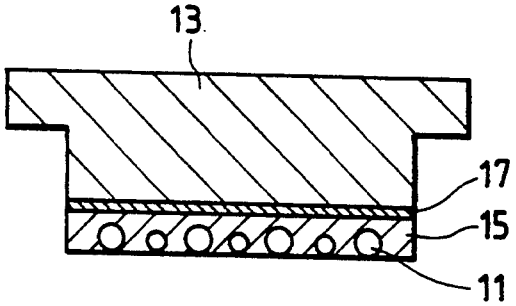
Figure 6E:
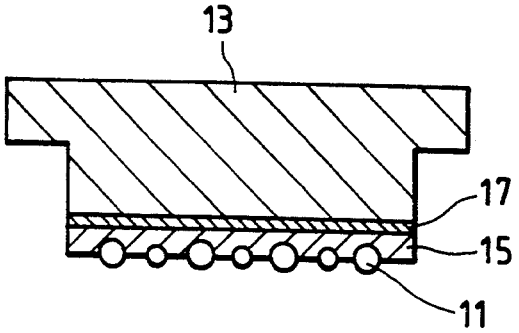
Figure 7:
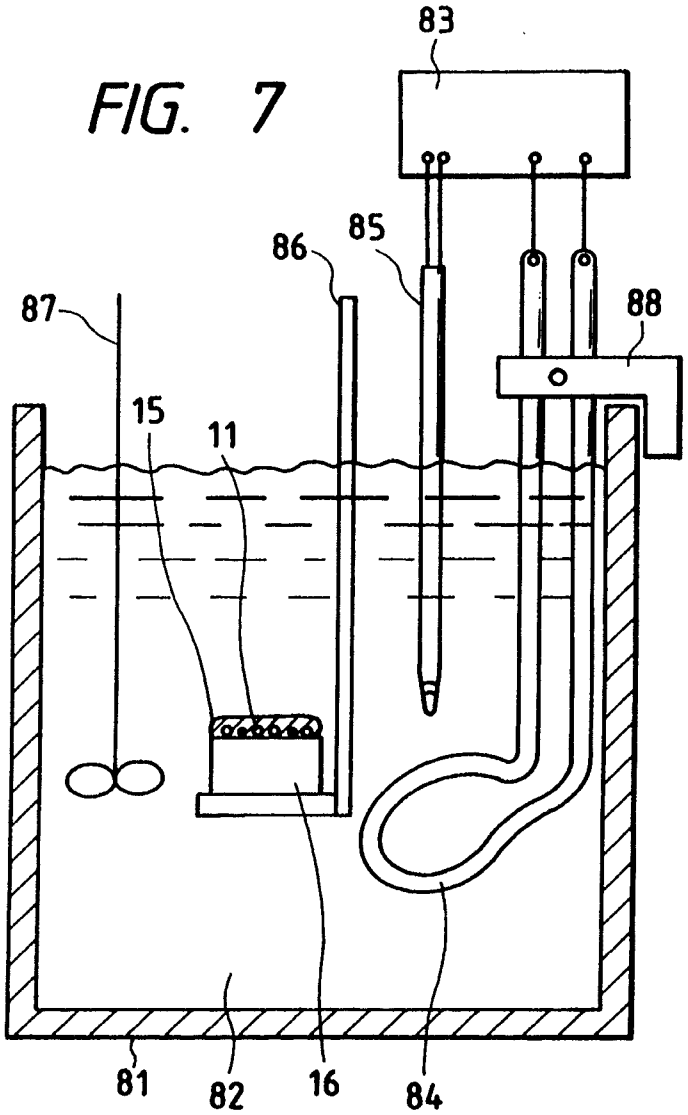
FIG. 7 is a schematic view of a plating apparatus for forming the binding plated layer on the surface of the mold member in the precise grinding grindstone shown in FIGS. 6A to 6E.

In the present embodiment, the steps to the above-mentioned formation of the binding plated layer 15 were conducted in a plating apparatus shown in FIG. 7. FIG. 7 is a schematic view of a plating apparatus adapted for use in the formation of the binding plated layer 15 on the surface of the mold member 16, in the precise grinding grindstone shown in FIGS. 6A to 6E, but the apparatus will not be explained further as the structure thereof is similar to that of the plating apparatus shown in FIG. 5. The electroless plating liquid 82 was similar in composition to that employed in the first embodiment for forming the binding plated layer.

In the plating apparatus, the mold member 16 is placed on a fixing member 86 and immersed in the electroless plating liquid 82, and a plurality of grinding particles 11 are poured from upward the plating tank 81 toward the surface of the mold member 16. The grinding particles 11 sink in the liquid 82 and are placed in dispersed manner on the surface of the mold member 16. The grinding particles 11 are charged substantially uniformly over the entire surface of the mold member 16, in order that the particles 11 are distributed over the entire surface of the mold member 16. The grinding particles 11 can be distributed more uniformly by rotating the mold member 16 about the center thereof during the charging of the particles 11. In the present embodiment, since the contact surface of the binding plated layer 15 with the mold member 16 constitutes the grinding surface of the precise grinding grindstone as will be explained later, the shape of the grinding surface is not affected even if the grinding particles 11 are placed in two layers, so that it is not necessary to form the grinding particles 11 in one layer only.

The binding plated layer 15 was formed after the dispersed placement of the grinding particles 11, under the same conditions as those in the formation of the binding plated layer in the first embodiment. However, in the initial stage of formation of the binding plated layer 15, since the grinding particles 11 will drop from the surface of the mold member 16 if the electroless plating liquid 82 is agitated by the agitator 87, the plating is conducted for about 1 minute without such agitation, and the agitator 87 is activated after the grinding particles 11 are tentatively supported by the mold member 16. In the present embodiment, the plating was conducted for about 7 hours to form the binding plated layer 15 of a thickness of approx. 70 μm, thereby completely embedding the binding particles 11. Thus formed binding plated layer 15 was turned into a hardness of Hv 450 or higher by heat treatment, and the surface thereof formed into a shape coinciding with that of the substrate 13, as indicated by a broken line in FIG. 6B, for example by a grinding operation.

Figure 8:
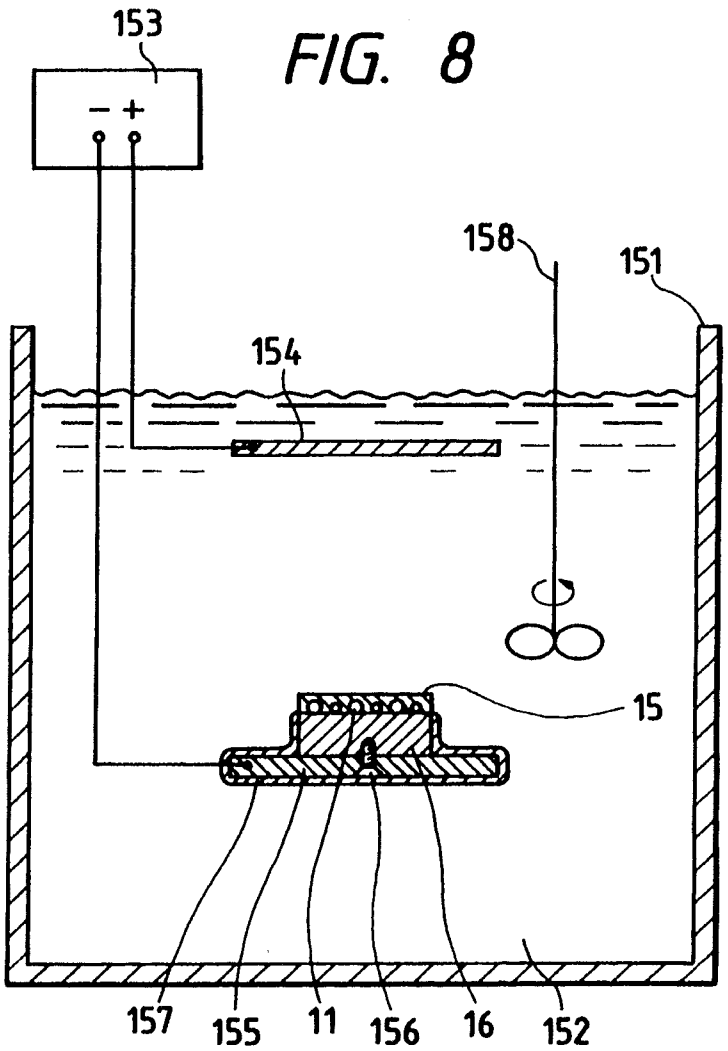
FIG. 8 is a schematic view of another plating apparatus for forming the binding plated layer on the surface of the mold member in the precise grinding grindstone shown in FIGS. 6A to 6E.

The binding plated layer 15 may be formed not only by the electroless nickel plating, but also by electrolytic nickel or copper plating. In case of the electrolytic nickel plating, there may be employed a plating apparatus as shown in FIG. 8. FIG. 8 illustrates another plating apparatus adapted for use in the formation of the binding plated layer on the surface of the mold member, in the precise grinding grindstone shown in FIGS. 6A to 6E. In the apparatus, in a similar manner as in the apparatus shown in FIG. 2, an anode 154 and a cathode 155 are provided, in mutually opposed manner, in plating liquid 152 filled in a plating tank 151. A plated layer is precipitated on the cathode side by applying a DC voltage between the anode 154 and the cathode 155 by a DC power source 153. The mold member 16 is fixed to the cathode 155 in conductive state by a conductive fixing screw 156. The cathode 155 is covered with a mask 157, except for the surface of the mold member 16. In this embodiment, the plating liquid containing nickel sulfate of 250 g/l, nickel chloride of 70 g/l, and boric acid of 30 g/l was employed, and the plating was conducted for 70 minutes under the conditions of a temperature of the plating liquid of 45° C., a current density of 5D/dm$^2$and a revolution of the agitator 158 of 60 rpm. As a result, on the surface of the mold member 16, there was formed the binding plated layer 15 with a thickness of approx. 70 μm, in which the grinding particles 11 were completely embedded. The process of dispersing the grinding particles 11 on the surface of the mold member 16 can be the same as explained above, and will not, therefore, be explained further.

Then, the substrate 13 is adhered by an adhesive material 17 on the surface of the binding plated layer 15 as shown in FIG. 6C. The binding plated nickel layer including the grinding particles 11 therein, are peeled off from the mold member 16 as shown in FIG. 6D. The surface of the substrate 13 is adhered to the surface, which has been worked to a shape coinciding with that of the surface of the substrate 13, of the binding plated layer 15, and the end positions of the grinding particles 11 are aligned along a plane having an inverted surfacial shape of that of the mold member 16. The adhesive material 17 is so selected that the adhesive force between the substrate 13 and the binding plated layer 15 is stronger than that between the mold member 16 and the binding plated layer 15 and can be, for example, a rapid-drying cyanobond adhesive material or an epoxy adhesive material. In the present embodiment, an epoxy adhesive material was employed as the adhesive 17. The mold member 16 was composed of stainless steel in order to achieve satisfactory peeling from the binding plated layer 15.

Figure 9:
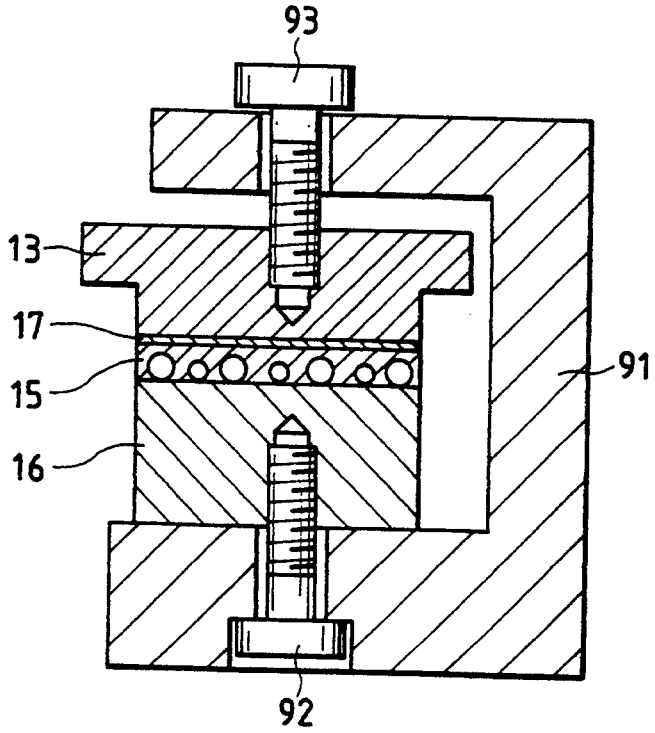
FIG. 9 is a schematic cross-sectional view of a peeling apparatus for peeling the mold member from the binding plated layer in the precise grinding grindstone shown in FIGS. 6A to 6E.

A peeling apparatus shown in FIG. 9 was employed for peeling the mold member 16. FIG. 9 is a schematic cross-sectional view of a peeling apparatus adapted for peeling the mold member from the binding plated layer, in the precise grinding grindstone shown in FIGS. 6A to 6E. As shown in FIG. 9, a base member 91 is provided with mutually opposed two arm portions. One of the arm portions is provided with a penetrating hole for accommodating a fixing screw 92 for fixing the mold member 16, while the other is provided with a penetrating hole for accommodating a peeling screw 93 for peeling the substrate 13 off from the mold member 16. The rear face of the mold member is provided with a threaded hole which engages with the fixing screw 92, while the rear face of the substrate 13 is provided with a threaded hole which engages with the peeling screw 93. Upon peeling the mold member 16, the mold member 16 to which the substrate is adhered through the binding plated layer 15, is fixed to an arm portion of the base member 91 by means of the fixing screw 92, and, in this state, the peeling screw 93 is screwed into the threaded hole of the substrate 13. In this operation, the substrate 13 is given an upward force, because the mold member 16 is fixed to an arm portion of the base member 91 by means of the fixing screw 92, while the position of the peeling screw is defined by the other arm portion of the base member 91. Also, as explained above, the adhesive force of the adhesive material 17 between the binding plated layer 15 and the substrate 13 is stronger than that between the binding plated layer 15 and the mold member 16. Consequently, the mold member 16 is peeled off from the binding plated layer 15 by screwing of the peeling screw 93.

Then, the surface of the binding plated layer 15 which has been peeled off from the mold member 16, is removed by a predetermined thickness with etching liquid capable of etching the binding plated layer 15, such as nitric acid or hydrochloric acid. In this manner, only the binding plated layer 15 is removed while the grinding particles 11 are not removed, so that the ends of the particles 11 protrude by a predetermined amount from the binding plated layer 15. The precise grinding grindstone is completed in this manner.

Figure 10:
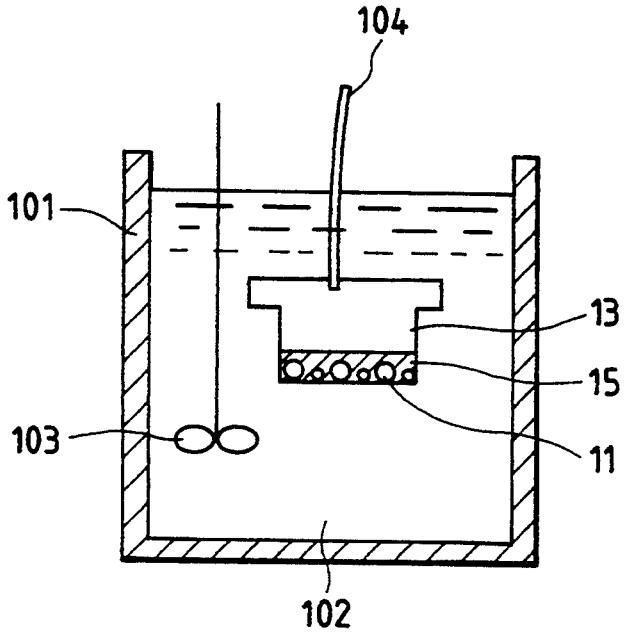
FIG. 10 is a schematic view of a plating etching apparatus for removing the surfacial part of the binding plated layer in the precise grinding grindstone shown in FIGS. 6A to 6E.

The surfacial part of the binding plated layer 15 can be removed by an etching apparatus shown in FIG. 10. FIG. 10 is a schematic view of an etching apparatus adapted for removing the surfacial part of the binding plated layer, in the precise grinding grindstone shown in FIGS. 6A to 6E. The apparatus is provided with a tank 101 filled with etching liquid 102, and an agitator 103 for agitating the etching liquid 102 in the tank 101. The etching liquid 102 was composed of a 1:1:1 mixture of water, nitric acid and hydrochloric acid. The substrate 13 is fixed to a string 104 and immersed in the etching liquid 102, whereby the binding plated layer 15 is etched to expose the ends of the grinding particles 11. In this operation, in order to etch the surface alone of the plated layer 15, other parts of the plated layer 15 and the substrate 13 are preferably masked. In the present embodiment, the etching liquid 102 was maintained at the room temperature, and the substrate 13 was immersed in the etching liquid 102 for 10 minutes, whereby the surfacial part of the binding plated layer 15 was removed by about 3 μm.

As explained in the foregoing, the grinding particles placed on the surface of the mold member 16 are supported with the binding plated layer 15, then the binding plated layer 15 is adhered to the substrate 13, thereafter, peeled from the mold member 16, whereby the parts of the grinding particles contacting the mold member 16, constitute the ends of the particles 11, so that the heights of the particles 11 are aligned along the surface of the mold member 16. Also, the protruding amount of the ends of the grinding particles 11 can be arbitrarily regulated by the amount of the binding plated layer 15 removed by the etching liquid.

Third Embodiment

Figure 11:
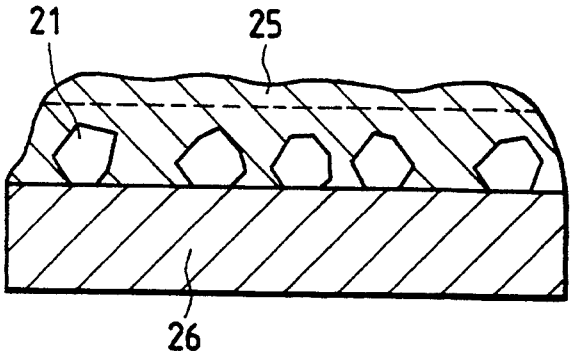
FIG. 11 is a cross-sectional view of a state in which vapor phase deposited diamonds are covered with a binding plated layer in the producing process of a third embodiment of the precise grinding grindstone of the present invention.

In this embodiment, as shown in FIG. 11, vapor phase deposited diamonds 21 of a size of about 12 μm are precipitated by microwave plasma CVD on a mold member (composed of tungsten carbide) 26 and are supported by a binding plated layer 25. Prior to the CVD treatment, the surface of the mold member 26 is given minute scars for example by ultrasonic vibration of grinding particles other than those obtained in the present embodiment. The vapor phase deposited diamonds 21 are precipitated on thus formed scars. The CVD treatment was conducted for 10 hours at a reaction temperature of 800° C., in $H_2$ atmosphere containing $CH_4$ at a concentration of 0.5%.

Then, the surface of the binding plated layer 25 is formed into a shape coinciding with that of a substrate (composed of carbon steel; not shown) as indicated by a broken line, then the substrate is adhered onto the surface of the binding plated layer 25, and the plated layer 25 is peeled off from the mold member 26. Since the adhesion between the mold member 26 and the vapor phase deposited diamonds 21 is weaker than the adhesive force between the diamonds 21 and the binding plated layer 25, it can be peeled from the mold member 26 without leaving the diamonds 21 thereon, by giving a mechanical impact to the mold member 26.

After peeling of the binding plated layer 25, the precise grinding grindstone can be prepared by the steps similar to those in the second embodiment.

By precipitating the vapor phase deposited diamonds 21 on the surface of the mold member 26 by microwave plasma CVD as in the present embodiment, the grinding particles composed of the diamonds 21 can be securely dispersed in a single layer on the mold member 26 without the horizontal vibration thereof, so that the end heights of the particles can be easily aligned.

Fourth Embodiment

This embodiment utilizes precipitation of the vapor phase deposited diamonds on the surface of the mold member by microwave plasma CVD as in the third embodiment, and is the same as third embodiment except for a process applied to the substrate prior to the CVD treatment. Consequently, the process alone will be explained in the following, and other steps are omitted from the explanation.

At first, the surface of the substrate is subjected to a treatment of forming minute scars, and then a matrix pattern of dots of a diameter of 2 μm of PMMA photoresist is formed as a mask with a mask aligner on the surface. Subsequently, the surface is etched by Arion beam except for the patterns of the PMMA photoresist, and the patterns are removed, whereby the scarred areas remain in a dot matrix pattern on the surface. Thus, the microwave plasma CVD process applied on the surface in the same manner as in third embodiment causes precipitation of the vapor phase deposited diamonds only in such scarred areas. The CVD was conducted for 15 hours at a reaction temperature of 800° C., in $H_2$ atmosphere containing $CH_4$ at a concentration of 0.5%, and the precipitated diamonds had a particle size of about 20 μm.

In this manner, the distribution density of the vapor phase deposited diamonds can be arbitrarily selected by defining the positions of precipitation thereof through partial etching of the substrate surface subjected to the scar formation. Also, since the distance of the diamond particles can be selected, the diamonds of a required size can be obtained with a substantially uniform particle size.

Fifth Embodiment

In this embodiment, a forming grindstone, so called "spherical dish", with a spherical grinding surface is produced by a process similar to that of the second embodiment.

Figure 12A:
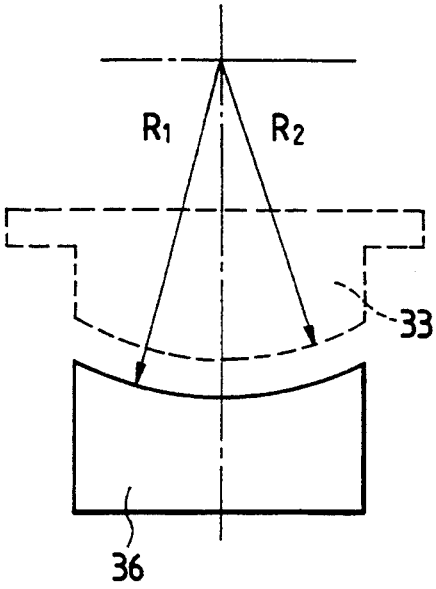
FIGS. 12A and 12B are cross-sectional views of a mold member and a substrate to be employed in the preparation of a forming grindstone with a spherical grinding surface, by a process similar to that shown in FIGS. 6A to 6E.

In producing the forming grindstone of with a spherical-grinding surface, there are employed, as shown in FIGS. 12A and 125, spherical mold members 36, 46 and substrates 33, 43. In case of producing a forming grindstone with a convex spherical surface with a curvature radius $R_0$, the mold member 36 is formed, as shown in FIG. 12A, as a concave face with a curvature radius $R_1$ represented by $R_1=R_0$. The substrate 33 has a convex spherical surface with a radius curvature $R_2$ represented by $R_2 \cong R_0-(d+e)$ wherein d is the thickness of the binding plated layer and e is the thickness of the adhesive material. On the other hand, in case of producing a forming grindstone with a concave spherical surface with a radius curvature $R_0$, the mold member 46 has a convex surface with a radius curvature $R_3$ represented by $R_3=R_0$, as shown in FIG. 125. The substrate 43 has a concave surface with a curvature radius $R_4$ represented by $R_4 \cong R_0+(d+e)$.

Therefore, in case of producing a forming grindstone with a convex spherical surface and a forming grindstone with a concave spherical surface each having a curvature radius 50.00 mm, a thickness of binding plated layer of 0.07 mm and a thickness of the adhesive material of 0.05 mm, there are employed a concave mold member 36 with a curvature radius of 50.00 mm and a convex substrate 33 with a curvature radius with a 49.88 mm for the forming grindstone of concave spherical surface. Also, there are employed a convex mold member 46 with a curvature radius of 50.00 mm and a concave substrate 43 with a curvature radius of 50.12 mm for the forming grindstone with a concave spherical surface. On the precise grinding grindstones produced by the same method as that of the second embodiment except that the mold members 36, 46 and the substrates 33, 43 are different in shape, it was confirmed that the end heights of the grinding particles were aligned along the convex and concave spherical surfaces with a curvature radius of 50.00 mm.

Figure 13:
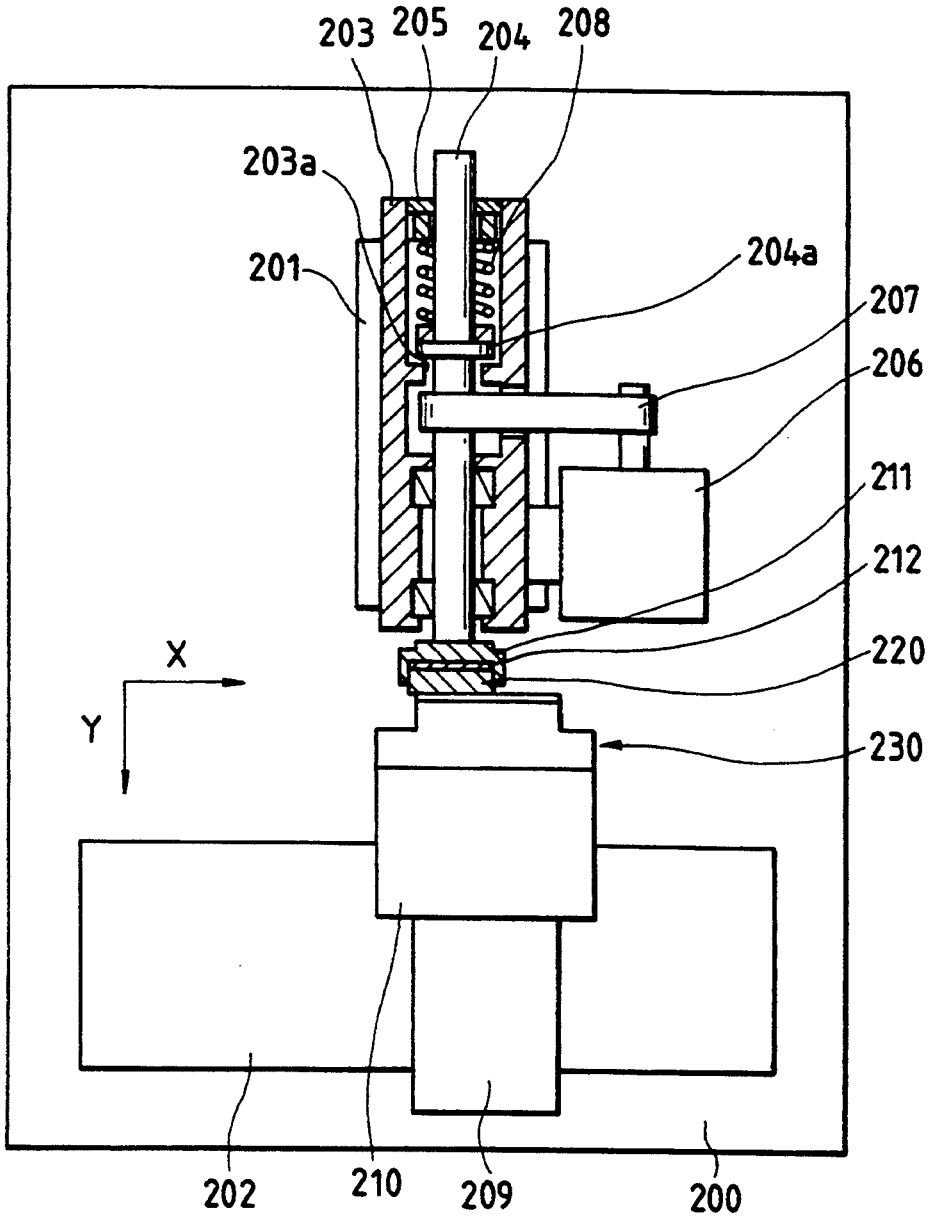
FIG. 13 is a partially cut-off schematic plan view of a precise grinding apparatus to be employed in precise grinding of a work piece.

In the following there will be explained the precise grinding method of a work article utilizing the precise grinding grindstone of the present invention. For such method there is employed a precise grinding apparatus as shown in FIG. 13, which is a partially cut-off schematic plan view of the precise grinding apparatus which is adapted for use in the precise grinding of a work article and which is similar to the ordinary precise grinding apparatus. On a table 200, a housing 203 is provided movably in the Y-direction across a Y-direction driving mechanism 201. The housing 203 supports a work piece rotating spindle 204 rotatable and movable in the Y-direction. A belt 207 is provided between the spindle 204 and the output shaft of a work piece rotating motor 206 fixed to the Y-direction driving mechanism 201, whereby the rotation of the motor 206 is transmitted to the spindle 204.

At the lower end in the drawing of the spindle 204, there is fixed a chuck 211 which supports the work piece across a contact member 212, provided for absorbing the vibration of the work piece 220 during the grinding operation and composed, for example, of rubber. In the middle of the work piece rotating spindle 204 there is provided a flange 204*a*, while, at the upper end of the housing 203 there is provided a pressure setting screw 205 which is penetrated by the spindle 204, and a pressurizing coil spring 208 is provided between the flange 204*a* and the pressure setting screw 205. In this manner the spindle 204 is biased downwards, but, when the grinding operation is not conducted, the flange 204*a* impinges on a stopper 203*a* provided on the internal wall of the housing 203, thereby limiting the position of the work piece rotating spindle 204.

On the other hand, in a position of the table 200 opposed to the chuck 211, a grindstone rotating motor 209 is provided, movably in the X-direction, by an X-direction moving mechanism 202. On the output shaft (not shown) of the motor 209, there is fixed a grindstone mounting member 210 on which a precise grinding grindstone 230 is mounted by screws (not shown ) .

For effecting the grinding work with the above-explained configuration, the housing is at first sufficiently separated from the grindstone mounting member 210 by the Y-direction driving mechanism 201, then the work piece 220 is mounted across the contact member 212 to the chuck 211, and the precise grinding grindstone 230 is mounted on the grindstone mounting member 210. Subsequently, the housing 203 is brought close to the precise grinding grindstone 230 by the Y-direction driving mechanism 201, thereby bringing the work piece 220 in contact with the precise grinding grindstone 230. By bringing further the housing 203 closer to the grindstone 220 even after the contact, the spindle does not move but the housing 203 alone moves, so that the pressurizing coil spring 208 is compressed. Thus, the work piece 220 is pressed to the precise grinding grindstone 230 with a force corresponding to the amount of compression of the spring 208. In this manner the work piece 220 is pressed with a predetermined load to the precise grinding grindstone 230, and the work piece 220 is ground by rotating the work piece 220 and the precise grinding grindstone 230 in this state. In such grinding operation of the work piece 220, in order to prevent eccentric abrasion of the precise grinding grindstone 230, it is reciprocated in the X-direction by the X-direction driving mechanism 202 when required.

In the following there will be explained an experimental example of precise grinding of a lens with the above-explained grinding apparatus. In this example, the finished surface roughness $R_{max}$ and work removing efficiency of the lens were measured in a grinding operation with the precise grinding grindstone of the second embodiment (called "experimental grindstone"). In this example, the grinding operation was conducted for 15 seconds with a load of 6 kg, while the grindstone and the work piece were rotated at 7000 rpm (for grindstone) and 60 rpm (for work piece). The work piece consists of a glass material SF6 with a diameter of 10 mm and a thickness of 3 min. For the purpose of comparison, similar experiments were conducted with a conventional metal pellet and a resin pellet. The obtained results are summarized in Table 1.

TABLE 1

| | Finished surface roughness $R_{max}$ (μm) | Work removing efficiency (μm/15 sec) |
|---|---|---|
| Experimental grindstone | 0.1 or less | 20 |
| Metal pellet | 1–2 | 15 |
| Resin pellet | 0.3 | 6 |

As shown in Table 1, the experimental grindstone provided a finished surface roughness $R_{max}$ even better than the relatively satisfactory surface roughness obtained in the resin pellet. Also, the resin pellet shows an inferior work removing efficiency because the grinding particles sink into the binder resin, while the experimental grindstone shows an efficiency at least equal to that of the metal pellet. Thus, the experimental grindstone has the combined advantages of those of the metal pellets and the resin pellets. The service life of the resin pellet, though not shown in Table 1, was worst because the binder is abraded quickly. The experimental grindstone shows an abrasion resistance at least comparable to that of the metal pellets. More specifically, the amount of abrasion of the experimental grindstone was 1 μm when 1000 glass pieces were ground under the above-mentioned conditions.

Owing to the above-explained configuration, the present invention provides the following advantages.

In the precise grindstone of the present invention and the producing process therefor, the end heights of the grinding particles can be aligned with high precision, because the positions of the grinding particles are defined by a mold member of which surface coincides with the grinding surface of the grindstone to be produced. As a result, there can be obtained a precise grinding grindstone in which the work amounts of the grinding particles upon grinding operation are averaged and which can therefore achieve the grinding operation with a satisfactory surface roughness and in an efficient manner. The protrusion of each grinding particle can be easily set by regulating the thickness of adjustment or the removing amount of the binder layer so as to cause no clogging of the gaps of the particles and to avoid the dropping of the particles.

Also, in the precise grinding grindstone and the producing process therefor, in which the grinding particles are pressed toward the supporting layer by the mold member, the particles can be more easily pressed into the supporting layer by rendering the layer softer than the grinding particles. As a result, the end heights of the grinding particles can be easily aligned without breakage of the particles.

Also, in the precise grinding grindstone in which the binder layer is formed so as to cover the grinding particles dispersed on the mold member, then the substrate is adhered to the surface of the binder layer and the binder layer is peeled from the mold member, and in the producing process therefor, the grinding particles can be securely dispersed as a single layer on the surface of the mold member by precipitating artificial diamonds on the surface by vapor phase deposition.

What is claimed is:

1. A precision polishing/grinding tool, comprising:
a substrate;
a supporting material layer formed on a surface of said substrate;
a plurality of grinding particles dispersed as a single layer on a surface of said supporting material layer and pressed partially into said supporting material layer by a smoothly finished mold member; and
a binder layer formed on the surface of said supporting material layer in such a manner that ends of said grinding particles protrude therefrom at substantially the same height.

2. A polishing/grinding tool according to claim 1, wherein said supporting material layer is softer than both said grinding particles and said binder layer.

3. A precision polishing/grinding tool comprising:
a substrate;
a binder layer fixed on a surface of said substrate; and
a plurality of grinding particles dispersed in said binder layer, said particles protruding from said binder layer at substantially the same height, wherein said tool is produced by:
dispersing a plurality of grinding particles on a surface of a smoothly finished mold member;
forming a binder layer covering said grinding particles;
fixing a substrate on said binder layer;
peeling said binder layer from said mold member; and
removing a surfacial portion of said binder layer to expose said grinding particles.

4. A polishing/grinding tool according to claim 3, wherein said grinding particles are dispersed on the surface of the mold member by precipitating and growing artificial diamonds on the surface of the mold member by vapor phase deposition.

5. A polishing/grinding tool according to claim 3, wherein the surfacial portion of said binder layer is removed by an acid treatment.

6. A polishing/grinding tool according to claim 4, wherein the surfacial portion of said binder layer is removed by an acid treatment.

7. A process for producing a a precision polishing/grinding tool, comprising the steps of:
forming a supporting material layer on a surface of a substrate;
dispersing a plurality of grinding particles in a single layer on a surface of said supporting material layer;
pressing the grinding particles partially into the supporting material layer with a smoothly finished mold member; and
forming a binder layer on the surface of the supporting material layer in such a manner that ends of the grinding particles protrude at substantially the same height.

8. A process according to claim 7, wherein the supporting material layer is softer than both the grinding particles and the binder layer.

9. A process for producing a precision polishing/grinding tool, comprising the steps of:
dispersing a plurality of grinding particles on a surface of a smoothly finished mold member;
forming a binding layer on the surface of the mold member to cover the grinding particles;
fixing a substrate on a surface of the supporting binding layer;
peeling the binding layer from the mold member; and
removing a surfacial portion of the binding layer to expose the ends of the grinding particles.

10. A process according to claim 9, wherein the grinding particles are dispersed on the surface of the mold member by precipitating and growing artificial diamonds on the surface of the mold member by phase vapor deposition.

11. A process according to claim 9, wherein the surfacial portion of the supporting material layer is removed by an acid treatment.

12. A process according to claim 10, wherein the surfacial portion of the supporting material layer is removed by an acid treatment.

13. A process for grinding a work surface of a work piece by pressing a precision polishing/grinding tool onto the work surface and causing relative movement between the work piece and the grinding tool, wherein the polishing/grinding tool is formed by the steps of:
forming a first supporting layer on a substrate;
dispersing grinding particles on the first supporting layer and supporting the grinding particles in a state in which first ends of the grinding particles are aligned; and
forming a second supporting layer on the first supporting layer such that the first ends of the grinding particles are exposed from the surface of the second supporting layer at substantially the same height.

14. A process according to claim 13, wherein the work piece is a glass material;
the grinding particles are composed of diamond, alumina or CBN with an average particle size of 50 μm, for the purpose of working the glass material; and
the exposed height of the grinding particles from the surface of the second supporting layer is within a range of 8 to 12 μm.

15. A process according to claim 14 wherein the first and second supporting layers are plated layers.

* * * * *

UNITED STATES PATENT AND TRADEMARK OFFICE

CERTIFICATE OF CORRECTION

PATENT NO. : 5,374,293

DATED : December 20, 1994

INVENTOR(S) : Takashita et al.

It is certified that error appears in the above-indentified patent and that said Letters Patent is hereby corrected as shown below:

On the title page, item

[75] INVENTORS:

Under Kozakai, "Setagaya," should read --Tokyo,--.

COLUMN 3:

Line 12, "another invention," should read --another aspect of the invention--.

COLUMN 6:

Line 17, "m = (p X $\eta$ X $d^3$)/6" should read --m = (p X $\pi$ X $d^3$)/6--.

Line 27, "in particle," should read --in particular,--.

COLUMN 9:

Line 46, "5D/$dm^2$and" should read 5D/$dm^2$ and--.

COLUMN 11:

Line 66, "Arion" should read --Ar ion--.

COLUMN 12:

Line 24, "of" should be deleted.

Line 25, "cal-grinding" should read --cal grinding--.

Line 26, "125," should read --12B,--.

Figure 12B:
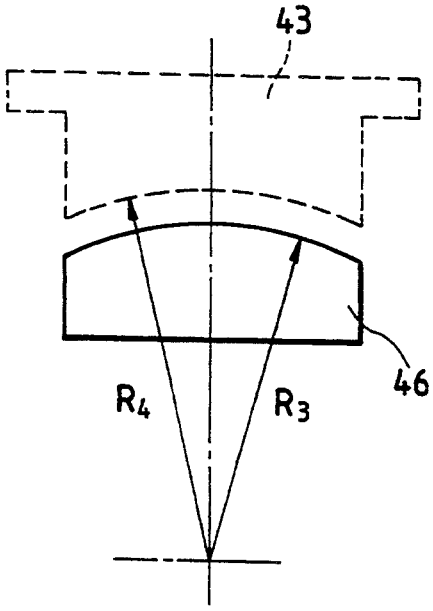

Line 39, "FIG. 125." should read --FIG. 12B.--.

UNITED STATES PATENT AND TRADEMARK OFFICE

CERTIFICATE OF CORRECTION

PATENT NO. : 5,374,293

DATED : December 20, 1994

INVENTOR(S) : Takashita et al.

It is certified that error appears in the above-indentified patent and that said Letters Patent is hereby corrected as shown below:

COLUMN 14:

Line 4, "3 min." should read --3 mm.--.

COLUMN 15:

Line 47, "a a" should read --a--.

COLUMN 16:

Line 3, "protrude" should read --protrude therefrom--.
Line 14, "supporting" should be deleted.

Signed and Sealed this

Sixth Day of June, 1995

Bruce Lehman

*Attest:*

BRUCE LEHMAN

*Attesting Officer*

*Commissioner of Patents and Trademarks*